US005663614A

United States Patent [19]

Weng et al.

[11] Patent Number: 5,663,614

[45] Date of Patent: Sep. 2, 1997

[54] LIGHTING CIRCUIT MODULE FOR A SHOE

[76] Inventors: Ming-Bi Weng; Ming-Ta Chang, both of 8F-6, No. 100, Sec. 2, Hoping E. Rd., Taipei, Taiwan

[21] Appl. No.: 601,162

[22] Filed: Feb. 13, 1996

[51] Int. Cl.[6] ..... A43B 7/04; F21V 33/00

[52] U.S. Cl. ..... 315/360; 315/323; 36/137; 362/103; 362/800

[58] Field of Search ..... 362/103, 800, 362/802, 455; 315/323, 360, 245, 291; 36/137

[56] References Cited

U.S. PATENT DOCUMENTS

| | | | |
|---|---|---|---|
| 4,384,317 | 5/1983 | Stackpole | 362/183 |
| 4,848,009 | 7/1989 | Rodgers | 362/103 X |
| 4,860,177 | 8/1989 | Simms | 362/72 |
| 5,188,447 | 2/1993 | Chiang et al. | 362/103 |
| 5,457,900 | 10/1995 | Roy | 362/103 X |

*Primary Examiner*—Robert Pascal
*Assistant Examiner*—Arnold Kinkead
*Attorney, Agent, or Firm*—Beveridge, DeGrandi Weilacher & Young LLP

[57] ABSTRACT

A lighting circuit module including a switch, a control unit controlled by the switch, an oscillatory resistor connected to the control unit, a plurality of bulbs, and a plurality of amplification elements controlled by the control unit to drive the bulbs, the control unit including a time sequence circuit controlled by the oscillatory resistor to provide a time sequence pulse signal, a trigger circuit controlled by the switch to provide a trigger signal, a counter circuit controlled by the trigger signal of the trigger circuit to count the time sequence pulse signal of the time sequence circuit, a cycle time circuit, a timer circuit controlled by the counter circuit and the cycle time circuit to control a driver circuit, a driver circuit controlled by the timer circuit and the counter circuit to drive the bulbs through the amplification elements.

16 Claims, 7 Drawing Sheets

LIGHTING CIRCUIT MODULE FOR A SHOE

BACKGROUND OF THE INVENTION

The present invention relates to a lighting circuit module for a shoe, and relates more particularly to such a lighting circuit module which uses a plurality of amplification elements controlled by a control unit to drive a plurality of bulbs.

Various lighting circuit modules have been developed for use with shoes. FIG. 1 shows a regular lighting circuit module for shoes which is generally comprised of a light emitting diode 01 and a switch 02. The switch 02 is connected between the light emitting diode 01 and the battery power supply. When the switch 02 is activated, electricity is transmitted from the battery power supply to the light emitting diode 01, thereby causing the light emitting diode 01 to give off light. This structure of lighting circuit module is functional. However, because the intensity of light of the light emitting diode is weak, the light of the light emitting diode cannot be seen from a distance. If a lamp bulb is used to replace the light emitting diode, it cannot produce a flashing effect. Furthermore, the installation of a lamp bulb consumes too much power.

SUMMARY OF THE INVENTION

The present invention has been accomplished to provide a lighting circuit module for a shoe which eliminates the aforesaid drawbacks. It is one object of the present invention to provide a lighting circuit module which provides a high intensity light. It is another object of the present invention to provide a lighting circuit module which saves the consumption of battery power supply. According to one aspect of the present invention, the lighting circuit assembly comprises a switch, a control unit controlled by the switch, an oscillatory resistor connected to the control unit, a plurality of bulbs, and a plurality of amplification elements controlled by the control unit to drive the bulbs, wherein the control unit comprises a time sequence circuit controlled by the oscillatory resistor to provide a time sequence pulse signal, a trigger circuit controlled by the switch to provide a trigger signal, a counter circuit controlled by the trigger signal of the trigger circuit to count the time sequence pulse signal of the time sequence circuit, a cycle time circuit, a timer circuit controlled by the counter circuit, the cycle time circuit to control a driver circuit, a driver circuit controlled by the timer circuit and the counter circuit to drive the bulbs through the amplification elements. According to another aspect of the present invention, the amplification elements can be NPN transistors or PNP transistors.

DETAILED DESCRIPTION OF THE PREFERRED EMBODIMENT

Figure 1:
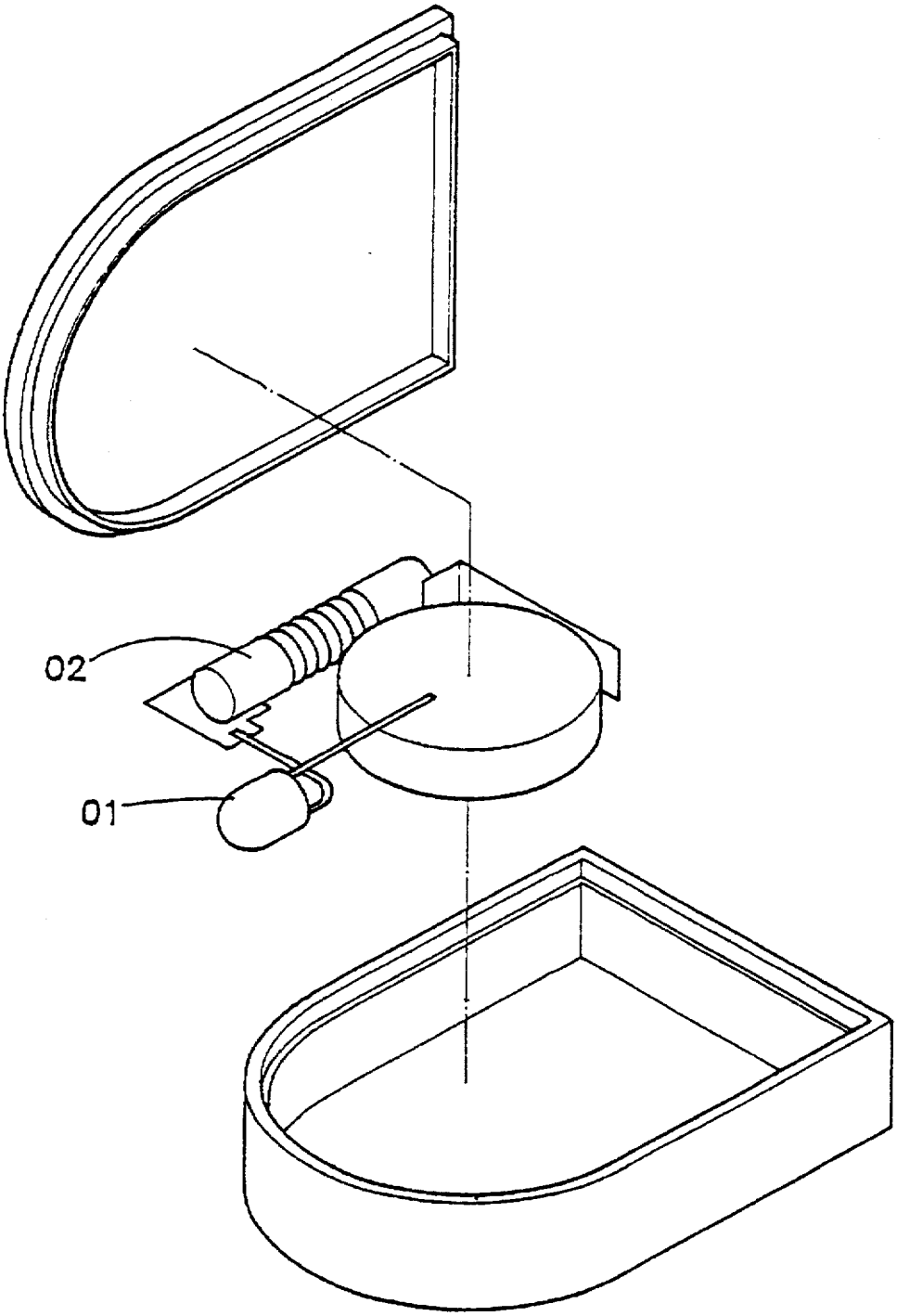
FIG. 1 PRIOR ART
FIG. 1 shows a lighting circuit module according to the prior art.
Figure 2:
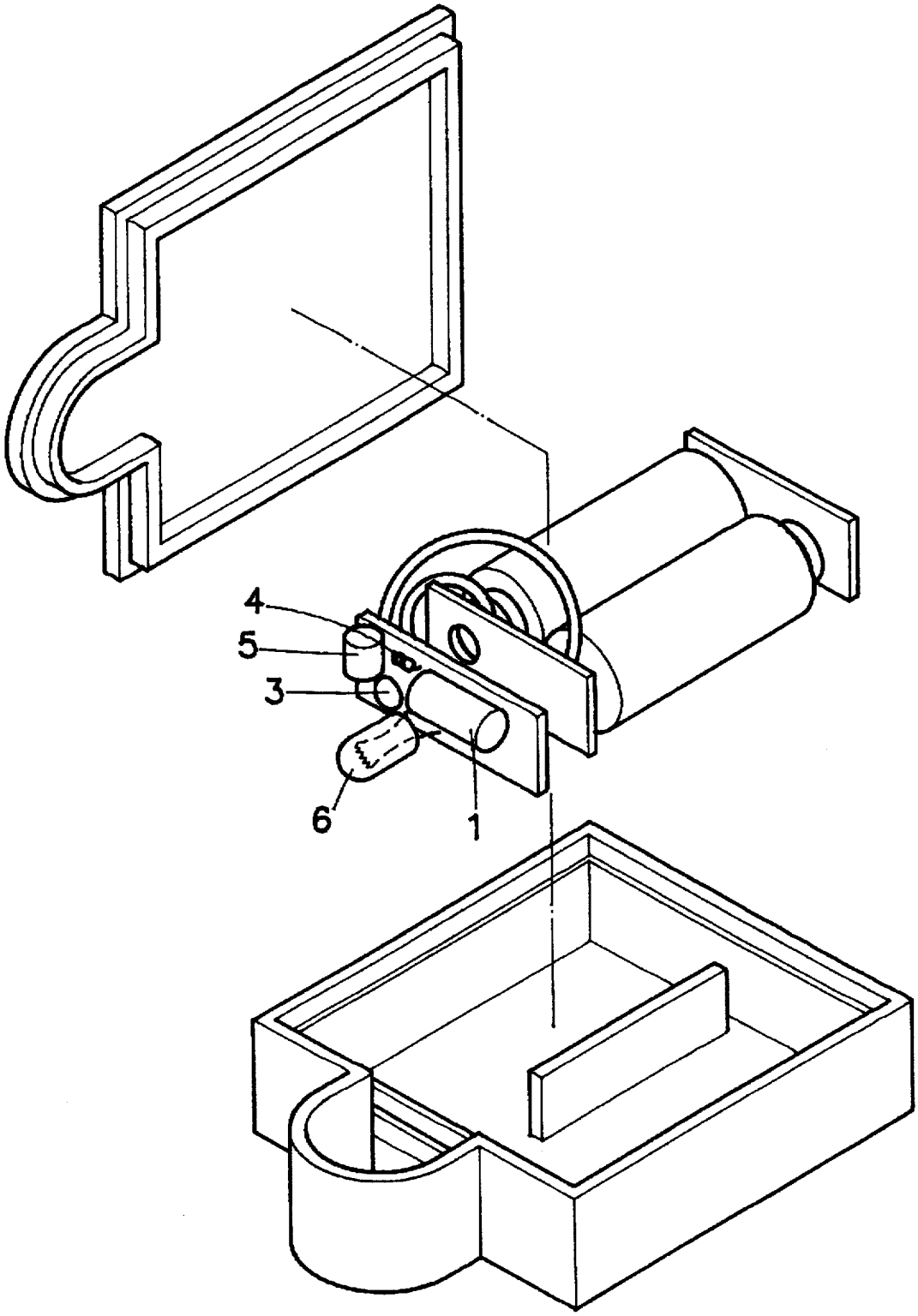
FIG. 2 shows a lighting circuit module according to the present invention.

Referring to FIG. 2, a lighting circuit module in accordance with the present invention is generally comprised of a switch 1, a control unit 3, an oscillatory resistor 4, a plurality of amplification elements 5, and a plurality of bulbs 6. When the lighting circuit module is assembled, it is inserted to a protective shell.

Figure 3:
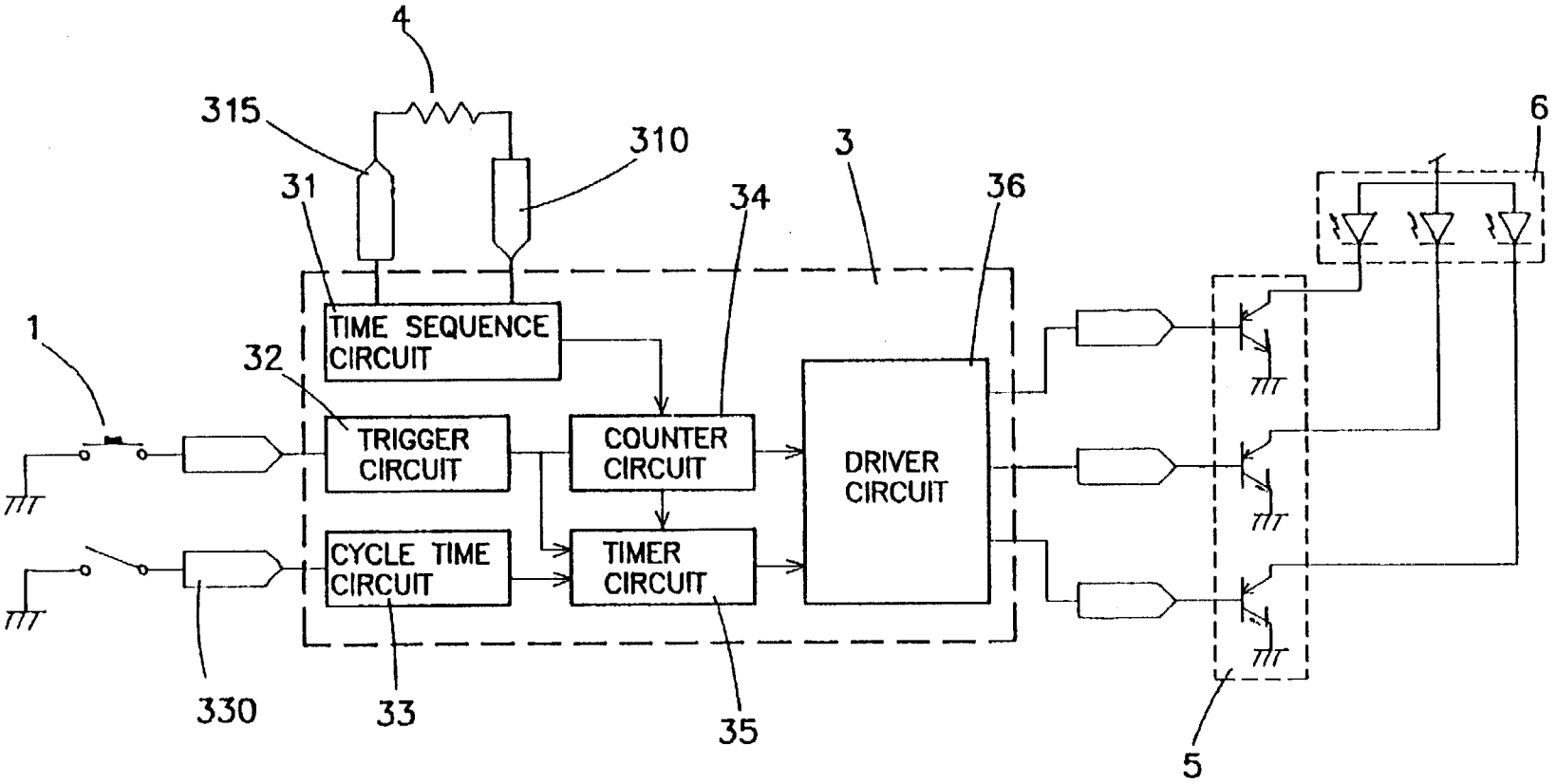
FIG. 3 is a circuit block diagram of the control unit of the lighting circuit module according to the present invention.
Figure 4:
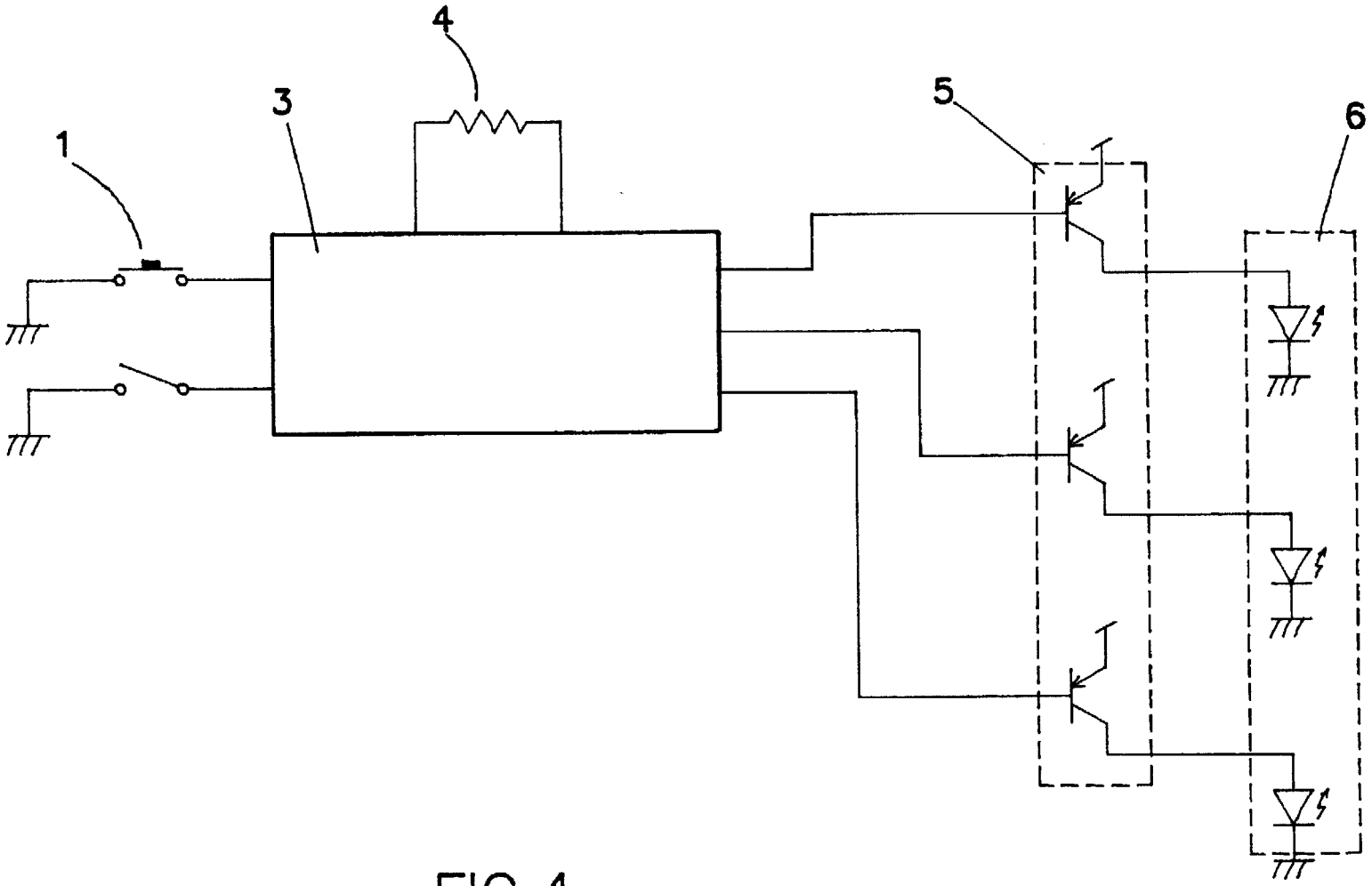
FIG. 4 is a circuit diagram of the lighting circuit module according to the present invention.

Referring to FIG. 3, the control unit 3 comprises a time sequence circuit 31 having terminals 310 and 315 connected to the oscillatory resistor 4, a counter circuit 34 with its input connected to the output of the time sequence circuit 31, a trigger circuit 32 with its input connected to the switch 1 and its output connected to the input of the counter circuit 34 and the input of the timer circuit 35, a cycle time circuit 33 with its output connected to the input of the timer circuit 35, and the driver circuit 36. The output of the counter circuit 34 is connected to the input of the timer circuit 35 and the input of the driver circuit 36. The output of the timer circuit 35 is connected to the input of the driver circuit 36. The oscillatory resistor 4 is connected between the input and output terminals 310 and 315 of the time sequence circuit 31. The cycle time circuit 33 has a cycle time selection terminal 330 at its input. The output of the driver circuit 36 is connected to the inputs of the amplification elements 5. The outputs of the amplification elements 5 are respectively connected to the bulbs 6. The time sequence circuit 31 is controlled by the oscillatory resistor 4 to provide an oscillatory time pulse signal (the frequency of the time pulse can be regulated by changing the impedance the oscillatory resistor 4) to the counter circuit 34. The counter circuit 34 counts the time pulse signal. When the switch 1 is switched on, the trigger circuit 32 is driven to provide a trigger signal to the counter circuit 34 and the timer circuit 35, causing the timer circuit 35 to be turned from the stand-by mode to the run mode. When the timer circuit 35 is turned into the run mode, the driver circuit 36 drives the bulbs 6 through the amplification elements 5, and then turns from the run mode to the stop mode subject to the nature of the signal from the counter circuit 34, causing the bulbs to be returned to the stand-by mode one, to five seconds after flashing. The switch 1 runs idle when the circuit is at the run or stop mode. The cycle time selection terminal 330 of the cycle time circuit 33 can be floated or connected to ground, and therefore the length of time of the run mode can be doubled, i.e., the flashing can be run twice. The amplification elements can be NPN transistors or PNP transistors as well (see FIG. 4). However, equivalent elements which achieve the same effect may be used.

Figure 5:
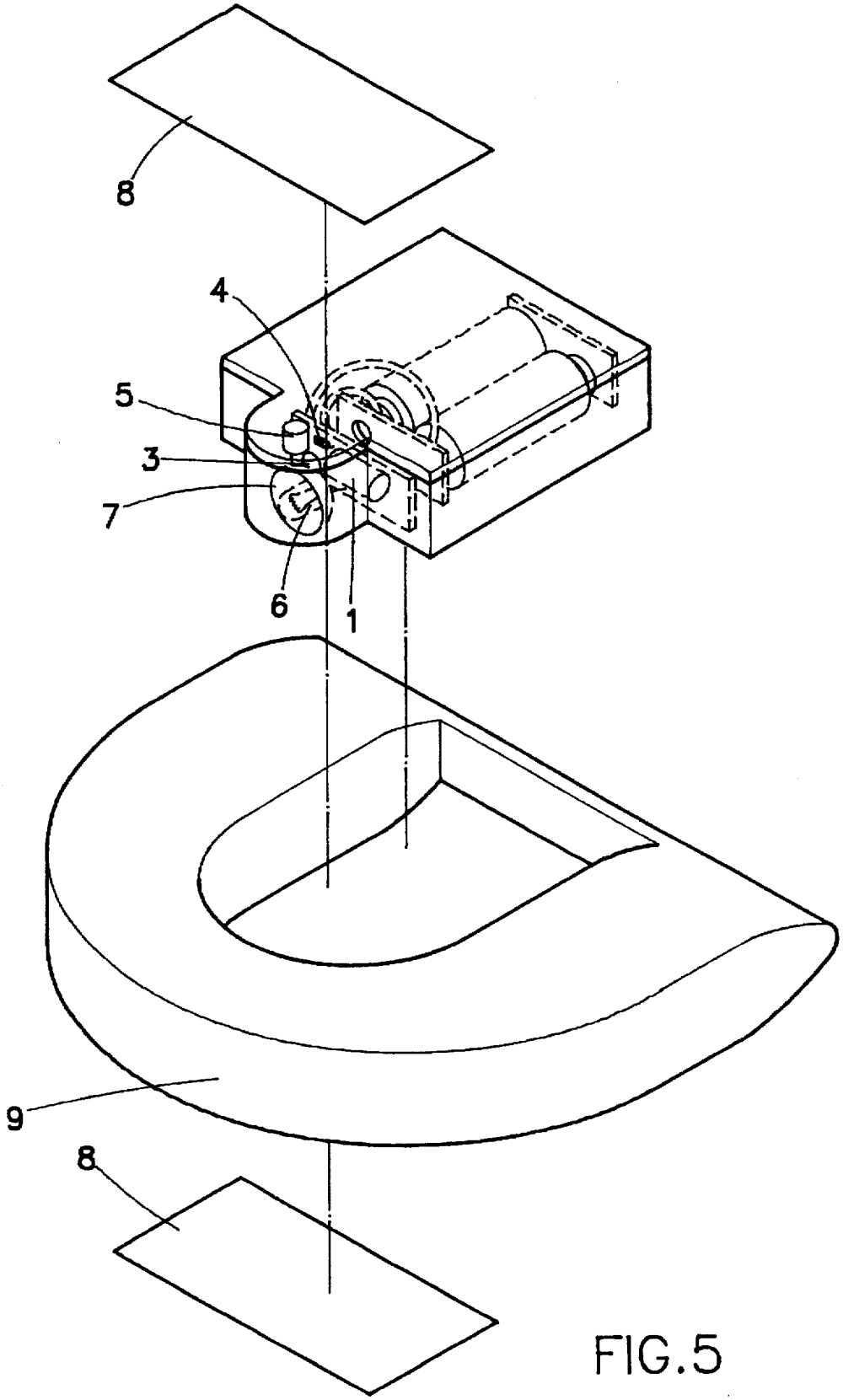
FIG. 5 is an exploded view of the lighting circuit assembly, the shield, and the foil reflectors according to the present invention.

Referring to FIG. 5, condensing lens means 7 and foil reflectors 8 may be mounted around the bulbs 6 to condense light and to reflect light and a shield 9 may be provided to protect the circuit module. The shield 9 can have any of a variety of shapes and colors, however it must allow light to pass through.

Figure 6:
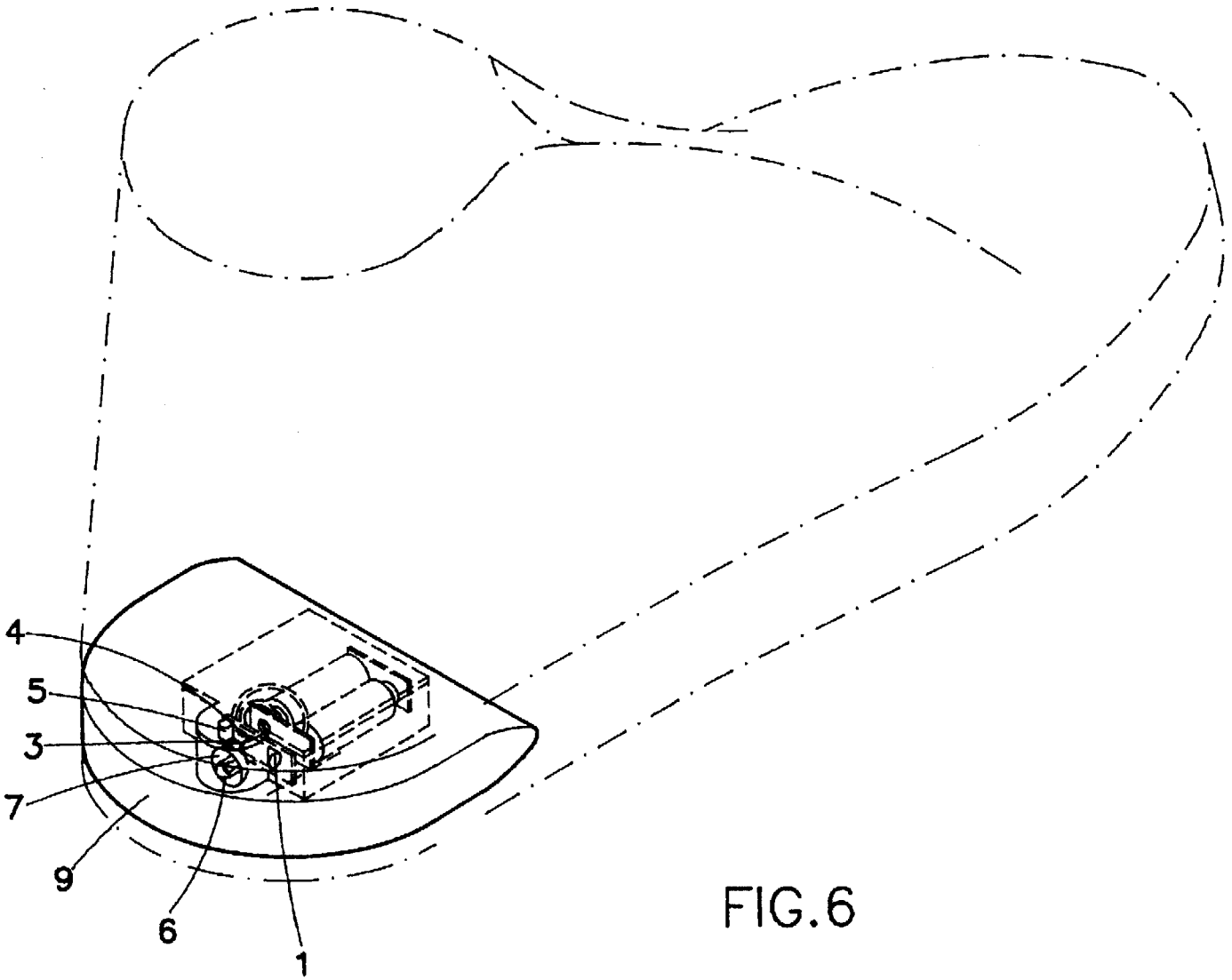
FIG. 6 is a schematic drawing showing the lighting circuit module of the present invention installed in the heel of a shoe.
Figure 7:
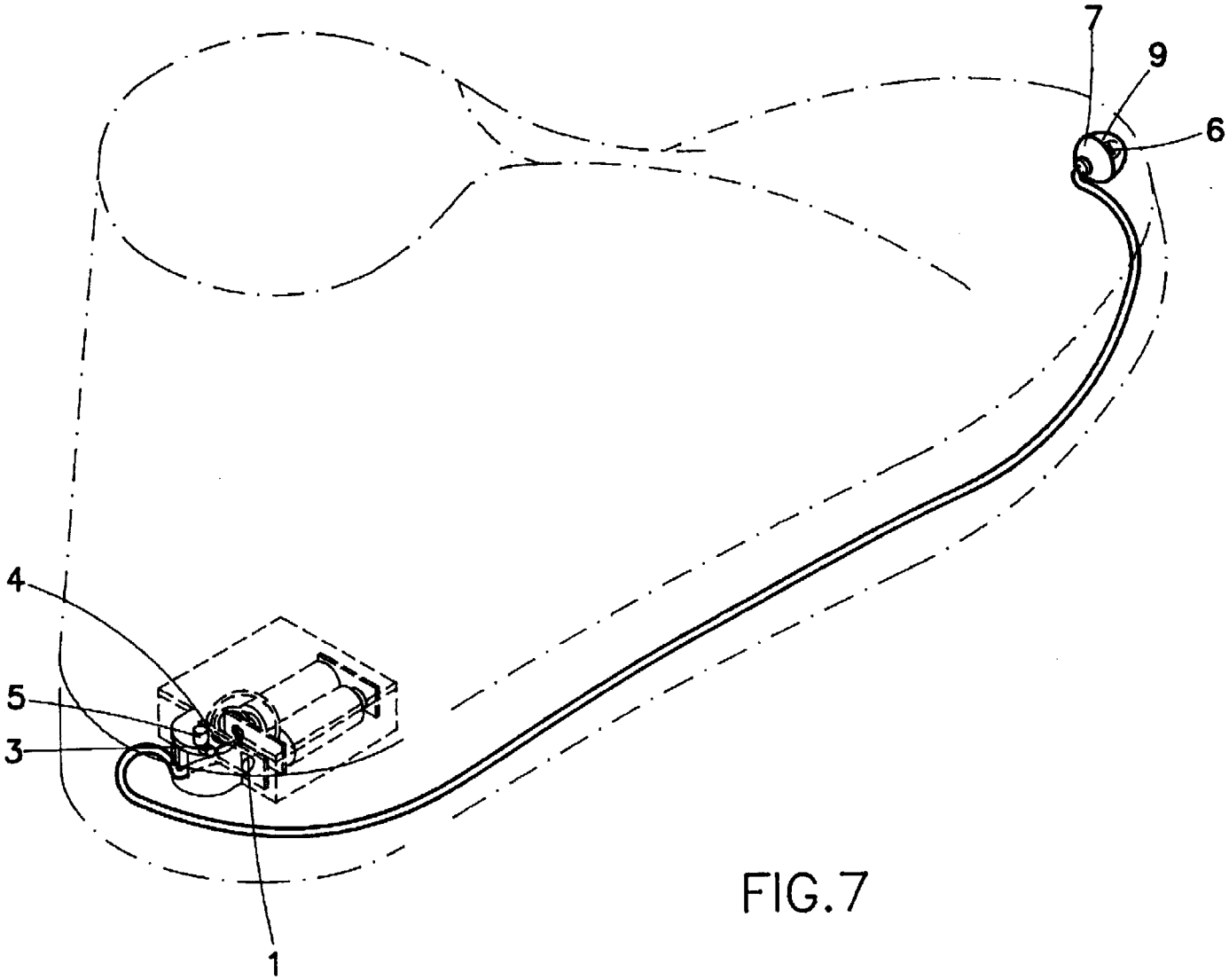
FIG. 7 shows another installation example of the lighting circuit module according to the present invention.

Referring to FIGS. 6 and 7, the lighting circuit module can be installed in the heel of the shoe, however, the bulbs 6 and the condensing lens means 7 can be installed at desired locations, for example, at the front side, outer side, or top side of the shoe.

It is to be understood that the drawings are designed for purposes of illustration only, and are not intended as a definition of the limits and scope of the invention disclosed.

What the invention claimed is:

1. A lighting circuit module disposed within a shoe comprising:

a switch, a control unit, an oscillatory resistor, a plurality of amplification elements, and a plurality of bulbs, said bulbs having inputs connected to said plurality of amplification elements;

said control unit including a time sequence circuit having input terminals connected to said oscillatory resistor, a counter circuit having an input connected to an output of said time sequence circuit, a trigger circuit having an input connected to said switch and an output connected to the input of said counter circuit and an input of a timer circuit, a cycle time circuit having an output connected to the input of said timer circuit, a driver circuit, said driver circuit being connected to inputs of said amplification elements, and a timer circuit having an input connected to the output of trigger circuit and an output of said counter circuit, and said timer circuit having an output connected to an input of said driver circuit;

said cycle time circuit having a cycle time selection terminal as an input;

said time sequence circuit being controlled by said oscillatory resistor to provide an oscillatory time pulse signal to said counter circuit;

said counter circuit counting said time pulse signal;

said trigger circuit being driven to provide a trigger signal to said counter circuit and said timer circuit when said switch is switched on causing said timer circuit to be turned from a stand-by mode to a run mode enabling said driver circuit to drive said bulbs through said amplification elements, and then to turn from said run mode to a stop mode subject to the nature of the signal from said counter circuit thereby causing said bulbs to be returned to said stand-by mode a predetermined length of time after flashing; and said switch running idle when said control unit is at said run or stop mode.

2. The light circuit module as defined in claim 1 wherein said module is within a heel of said shoe and the cycle time selection terminal of said cycle time circuit is floated.

3. The lighting circuit module as defined in claim 2 wherein said amplification elements are amplification transistors.

4. The lighting circuit module as defined in claim 2 wherein the quantity of said amplification elements is is equal to that of said bulbs.

5. The lighting circuit module as define in of claim 2 further comprising condensing lens means mounted around said bulbs to condense the light.

6. The lighting circuit module as defined in claim 2 further comprising reflector means mounted around said bulbs to reflect the light.

7. The lighting circuit module as defined in claim 2 wherein the stop mode of said timer circuit lasts from one to five seconds.

8. The lighting circuit module as defined in claim 2 further comprising a protective shield having a predetermined shape and color mounted around said bulbs.

9. The lighting circuit module as defined in claim 1 wherein said module is within a heel of said shoe and said bulbs are on the-exterior of said shoe and said cycle time selection terminal of said cycle time circuit is connected to ground.

10. The lighting circuit module as defined in claim 9 wherein said amplification elements are amplification transistors.

11. The lighting circuit module as defined in claim 9 wherein the number of said amplification elements is equal to the number of said bulbs.

12. The lighting circuit module as defined in claim 9 further comprising condensing lens means mounted around each of said bulbs to condense the light.

13. The lighting circuit module as defined in claim 9 further comprising reflector means mounted around each of said bulbs to reflect the light.

14. The lighting circuit module as defined in claim 9 wherein the stop mode of said timer circuit lasts from one to five seconds.

15. The lighting circuit module as defined in claim 9 further comprising a protective shield having a predetermined shape and color mounted around each of said bulbs.

16. A lighting circuit module disposed within a shoe comprising:

a switch, a control unit, an oscillatory resistor, a plurality of amplification transistors, a plurality of bulbs, said bulbs having inputs connected to said plurality of amplification transistors, the number of said bulbs being equal to the number of said amplification transistors, condensing lens means, said condensing lens means mounted around each of said bulbs to condense the light, a reflector means, said reflector means mounted around each of said bulbs, and a protective shield having a predetermined shape and color mounted around each of said bulbs;

said control unit including a time sequence circuit having input terminals connected to said oscillatory resistor, a counter circuit having an input connected to an output of said time sequence circuit, a trigger circuit having an input connected to said switch and an output connected to the input of said counter circuit and an input of a timer circuit, a cycle time circuit having an output connected to the input of said timer circuit, a driver circuit, said driver circuit being connected to inputs of said amplification elements, and a timer circuit having an input connected to the output of said trigger circuit and an output of said counter circuit, and said timer circuit having an output connected to an input of said driver circuit;

said cycle time circuit having a cycle time selection terminal as an input;

said time sequence circuit being controlled by said oscillatory resistor to provide an oscillatory time pulse signal to said counter circuit;

said counter circuit counting said time pulse signal;

said trigger circuit being driven to provide a trigger signal to said counter circuit and said timer circuit when said switch is switched on causing said timer circuit to be turned from a stand-by mode to a run mode enabling said driver circuit to drive said bulbs through said amplification transistors, and then to turn from said run mode to a stop mode subject to the nature of the signal from said counter circuit thereby causing said bulbs to be returned to said stand-by mode from one to five seconds after flashing; and said switch running idle when said control unit is at said run or stop mode.

* * * * *